US012618221B2

(12) United States Patent
Schauer et al.

(10) Patent No.: US 12,618,221 B2
(45) Date of Patent: May 5, 2026

(54) QUICK COUPLER AND QUICK COUPLER SYSTEM WITH SUCH A QUICK COUPLER

(71) Applicant: OilQuick Deutschland KG, Steindorf (DE)

(72) Inventors: Stefan Schauer, Kissing (DE); Michael Kollmann, Egling an der Paar (DE)

(73) Assignee: OilQuick Deutschland KG, Steindorf (DE)

( * ) Notice: Subject to any disclaimer, the term of this patent is extended or adjusted under 35 U.S.C. 154(b) by 391 days.

(21) Appl. No.: 18/207,871

(22) Filed: Jun. 9, 2023

(65) Prior Publication Data

US 2024/0026632 A1 Jan. 25, 2024

(30) Foreign Application Priority Data

Jul. 19, 2022 (DE) ..... 10 2022 117 974.5

(51) Int. Cl.
*E02F 3/36* (2006.01)
*E02F 3/96* (2006.01)

(52) U.S. Cl.
CPC ..... *E02F 3/3627* (2013.01); *E02F 3/3668* (2013.01); *E02F 3/3663* (2013.01)

(58) Field of Classification Search
CPC ..... E02F 3/3627; E02F 3/3668; E02F 3/3663; E02F 3/365; E02F 3/3604; E02F 3/3618; B60D 1/246
See application file for complete search history.

(56) References Cited

U.S. PATENT DOCUMENTS 5,244,047 A 9/1993 Eudy
6,058,633 A 5/2000 Barden
(Continued)

FOREIGN PATENT DOCUMENTS

CA 3081804 A1 9/2019
DE 10 2018 105049 A1 9/2019
(Continued)

OTHER PUBLICATIONS

Office Action dated Jul. 23, 2024, for Japanese Patent Application No. 2023-114865.
(Continued)

*Primary Examiner* — Joseph M Rocca
*Assistant Examiner* — Robert E Pezzuto
(74) *Attorney, Agent, or Firm* — Fleit Intellectual Property Law; Paul D. Bianco

(57) ABSTRACT

A quick coupler for changing attachments on a construction machine includes a carrier; first receptacles arranged on one side of the carrier for a first coupling element; second receptacles arranged on the other side of the carrier for a second coupling element; a locking device associated with the first receptacles, the locking device movable between release and locking positions; and a catch device arranged on the carrier with at least one catch hook arranged pivotably on the carrier for catching the attachment. A control element is arranged on the catch hook for pivoting the catch hook, independently of the locking device, between a folded-down change- and catch position and a folded-up safety position. The catch hook is pushed into its folded-down change- and catch position by a spring assembly.

9 Claims, 2 Drawing Sheets

(56) References Cited

U.S. PATENT DOCUMENTS

| | | | | |
|---|---|---|---|---|
| 8,011,121 | B2 * | 9/2011 | Daraie | E02F 3/365 37/444 |
| 8,262,310 | B2 * | 9/2012 | Sikorski | E02F 3/3618 37/468 |
| 11,643,788 | B2 | 5/2023 | Schmid | |
| 2013/0164080 | A1 * | 6/2013 | Miller | E02F 3/3604 403/373 |
| 2013/0234415 | A1 * | 9/2013 | Essex | B60D 1/246 280/504 |
| 2020/0399853 | A1 * | 12/2020 | Fälschle | E02F 3/365 |
| 2021/0238824 | A1 | 8/2021 | Anderson | |

FOREIGN PATENT DOCUMENTS

| | | | |
|---|---|---|---|
| DE | 10 2018 128479 | A1 | 5/2020 |
| DE | 10 2020 115 197.7 | A1 | 12/2021 |
| WO | 2019/170629 | A1 | 9/2019 |

OTHER PUBLICATIONS

Search Result for German Patent Application No. 10 2022 117 974.5 filed Jul. 19, 2022.

* cited by examiner

QUICK COUPLER AND QUICK COUPLER SYSTEM WITH SUCH A QUICK COUPLER

FIELD OF THE INVENTION

The invention relates to a quick coupler. The invention also relates to a quick coupler system comprising such a quick coupler and an associated adapter.

BACKGROUND

Such quick couplers are used for easy and convenient changing of different attachments on construction machines. With such a quick coupler, e.g. swing buckets, grabs, shears, compactors, magnets, hydraulic hammers or other attachments can be coupled or uncoupled in a few seconds and with a high safety standard from an operator's cab, e.g. on a boom of an excavator.

A generic quick coupler is known from DE 10 2018 128 479 A1. This includes a carrier which can be attached to a boom of an excavator and has, on one side, first receptacles with a locking device which can be moved between a release position and a locking position for holding a first coupling element provided on an attachment and, on the other side, second receptacles for holding a second coupling element spaced apart from the first coupling element. In order to prevent the attachments from falling and thereby possibly endangering persons in the event of an unintentional movement of the locking device into a release position, a catch device with two spaced-apart catch hooks is provided on the carrier. The catch hooks, which are completely independent of the locking device, enable an attachment to be safely caught and prevented from falling, even in the event of any operating errors of the locking device. Via a control element on the catch hooks, these can be pivoted by one of the two coupling elements between a folded-down change- and catch position and a folded-up safety position. Through the control element, a movement of the catch hook initiated by the attachment can thus take place. No separate drives are required. With the known quick coupler, the movement of the catch hooks into the folded-down change- and catch position is effected by gravity alone due to their own weight. In certain positions of the quick coupler, however, this can lead to problems during the changing process under certain circumstances.

SUMMARY

One aspect of the invention relates to a compactly constructed quick coupler of the type mentioned above and a quick coupler system with such a quick coupler, which enable a safe changing process with high precision and improved handling, regardless of the position of the quick coupler.

Expedient embodiments and advantageous further developments of the invention are disclosed herein.

In the quick coupler according to the invention, the catch device has at least one catch hook pivotably arranged on the carrier, on which a control element is arranged for pivoting the catch hook, independently of the locking device, between a folded-down change- and catch position and a folded-up safety position. The catch hook is pushed into its folded-down change- and catch position by a reset device arranged on the carrier. This ensures that the catch hook is securely in its folded-down change- and catch position when the attachment is not yet coupled, regardless of the position of the quick coupler. In the folded-down change- and catch position of the catch hook, an attachment can be changed by setting down appropriately on the ground and, if necessary, caught in a catch position by engaging the coupling element on the catch hook, thereby holding it on the quick coupler, while in the folded-up safety position the catch hook encloses the receptacle for a coupling element. By folding in the catch hook, a particularly compact design can be achieved, which can significantly reduce the risk of possible collisions with an attachment. The pivoting movement of the catch hook is controlled independently of the actuation of the locking device by a coupling element on the attachment to be coupled to the quick coupler. No additional control or actuation devices are required. A catch hook damaged by improper use can also be easily replaced without having to replace the entire carrier. There is no need to disassemble or replace the entire carrier.

In a particularly expedient embodiment, the reset device is designed as a spring assembly. It can comprise a bolt-shaped pressure element associated with the catch hook and preloaded by a pressure spring. The bolt-shaped pressure element can be arranged in a bore in the carrier and press with its upper end against the underside of the control element on the catch hook.

The control element for moving the catch hook between the folded-down change- and catch position and the folded-up safety position can expediently be designed as a nose-shaped driver projecting from the catch hook and arranged in the area of the second receptacles.

The catch device may comprise one or more catch hooks separated from or connected to each other. In a particularly expedient embodiment, the catch device can have two catch hooks arranged at a distance from one another on the carrier. The catch hooks are preferably arranged on the second receptacles of the carrier. The catch hooks can be actuated together or independently of each other.

In a stable design, the catch hooks can be arranged in central slots in two connecting bars projecting rearward from the carrier so that they can pivot about transverse axes.

Particularly secure holding can be achieved by the catch hook enclosing the coupling element in a semicircular manner. The catch hook can have an abutment surface on its underside for contact with a front contact surface of the carrier.

The invention also relates to a quick coupler arrangement comprising a quick coupler described above and an adapter that can be coupled to the quick coupler.

BRIEF DESCRIPTION OF THE DRAWINGS

Further features and advantages of the invention will be apparent from the following description of a preferred embodiment based on the drawing. It shows.

DETAILED DESCRIPTION

Figure 1:
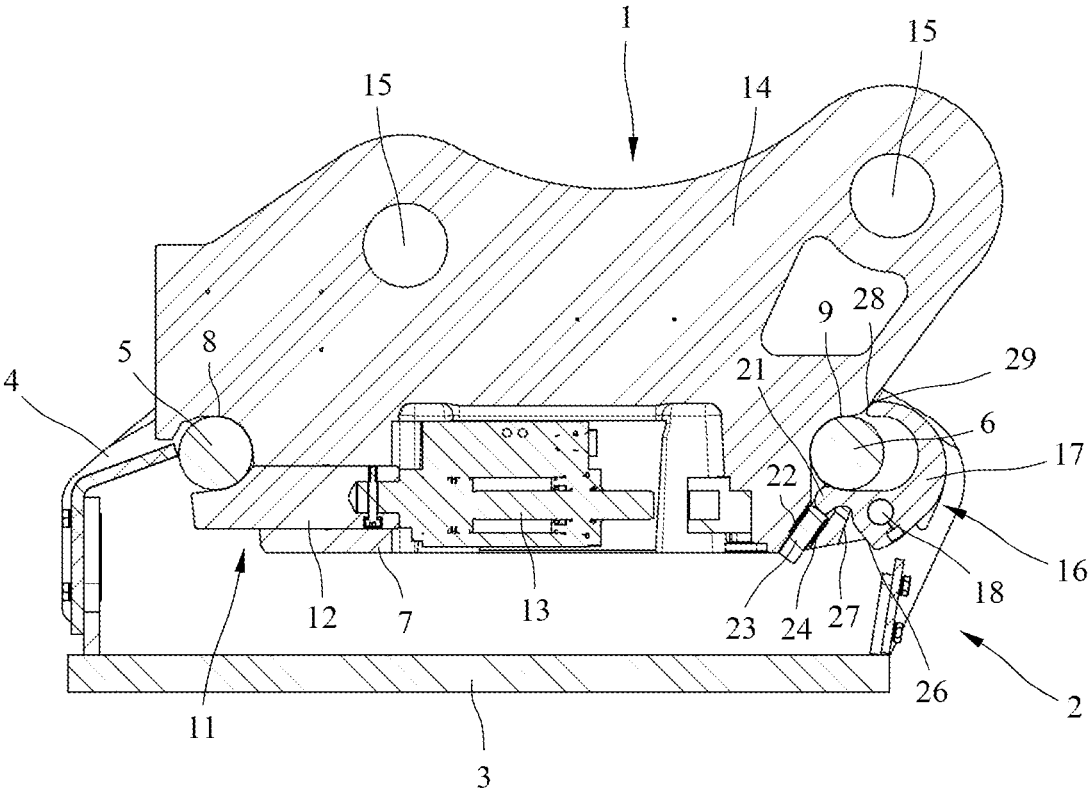
FIG. 1 a quick coupler system with a quick coupler and an adapter in a sectional view.

FIG. 1 shows a sectional view of a quick coupler system for easy and convenient changing of various attachments on construction machines, in particular excavators, consisting of a quick coupler 1 and an associated adapter 2. Such a quick coupler system can be used, for example, to easily and conveniently couple or uncouple swing buckets, grabs, shears, magnets, compactors, hydraulic hammers or other mechanical or hydraulic attachments to or from a boom or other mounting part of an excavator or other construction vehicle from an operator's cab.

The adapter 2, which can be attached to an attachment, contains a base plate 3 and two side plates 4 parallel to one another, between which a first bolt-shaped coupling element 5 and a second bolt-shaped coupling element 6 spaced at a predetermined distance therefrom are arranged for detachable connection to the quick coupler 1. The two bolt-shaped coupling elements 5 and 6 can be inserted into corresponding bores in the side plates 4 and fixed there.

Figure 2:
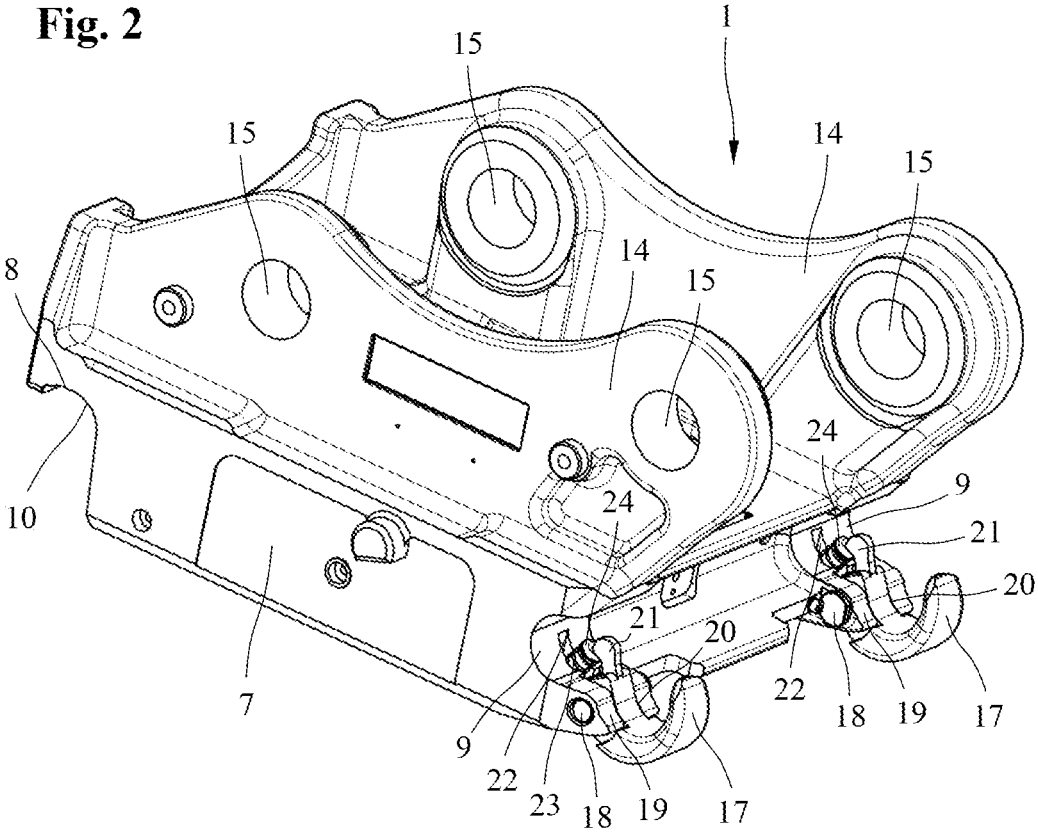
FIG. 2 the quick coupler of FIG. 1 in perspective.

The quick coupler 1, which is also shown in a perspective in FIG. 2, contains a carrier 7 designed as a welded construction or as a cast part, which has first receptacles 8 open downwards on one side for receiving and holding the first bolt-shaped coupling element 5 and second receptacles 9 open forwards on the other side for receiving and holding the second bolt-shaped coupling element 6.

In the embodiment shown, the quick coupler 1 includes two spaced receptacles 8 for the first coupling element 5 on one side of the carrier 7 and two receptacles 9 for the second coupling element 6 on the other side. The downwardly open first receptacles 8 have a curved lower contact surface 10 for contact with the first bolt-shaped coupling element 5. The second receptacles 9, which are open towards the front, are claw- or fork-shaped.

A locking device 11, which can be seen in FIG. 1, is provided on the two first receptacles 8 for lockably holding the first coupling element 5 on the carrier 7. In the embodiment shown, the locking device 11, which can be moved between a release position and a locking position, comprises two bolt-shaped locking elements 12, which are guided displaceably within the carrier 7 and can be moved by a cylinder 13 between an extended locking position shown in FIG. 1 and a retracted release position shown in FIG. 3 for releasing or coupling the adapter 2 or an attachment. In the extended locking position, the downwardly open first receptacles 8 are closed at the bottom by the locking elements 12 arranged displaceably in guide bores in the carrier 7, so that the first bolt-shaped coupling element 5 is engaged underneath by the bolt-shaped locking elements 12.

On its upper side, the carrier 7 includes two side parts 14 parallel to each other, in which continuous openings 15 are provided for fastening bolts, not shown, for fastening the quick coupler 1 to a boom of an excavator or a connecting part of another construction vehicle.

In order to couple an attachment with the aid of the quick coupler 1, the quick coupler 1, which is usually arranged on a boom of an excavator, is first moved in such a way that the second coupling element 6 arranged on the adapter 2 or directly on the attachment is retracted into the claw- or fork-shaped receptacles 9 on one of the sides of the quick coupler 1. Then, with the locking elements 12 still retracted, the quick coupler 1 is pivoted around the second bolt-shaped coupling element 6 in such a way that the first coupling element 5 on the adapter or attachment comes into contact with the contact surfaces 10 of the downwardly open receptacles 8 on the other side of the quick coupler 1. Subsequently, the locking elements 12, which are displaceably arranged in guide bores in the carrier 7 of the quick coupler 1, can be extended hydraulically so that the first bolt-shaped coupling element 5 is gripped underneath by the two bolt-shaped locking elements 12 on the quick coupler 1 and the attachment is thus held on the quick coupler 1.

In order to prevent an attachment coupled to the quick coupler 1 from disengaging from the quick coupler in the event of an unintentional disengaging movement of the locking element caused by incorrect operation or malfunctions and then possibly falling down in a raised position of the quick coupler 1, an additional catch device 16 is provided on the carrier 7. The catch device 16 is designed for gripping around the coupling element 6 arranged on the adapter 2 or attachment and engaging with the first receptacles 8. The catch device 16 is designed in such a way that, in the event of unintentional release from the coupling position, an attachment is caught in a catch position by engagement of the coupling element 6 on the catch device 16 and is thereby held on the quick coupler.

In the embodiment shown, the catch device 16 comprises two separate catch hooks 17, which are not rigidly arranged on the carrier 2 of the quick coupler 1 but are hinged to the carrier 1 via a type of hinge so as to pivot about a transverse axis 18. The two catch hooks 17 are arranged on the two receptacles 9 and are designed in such a way that they can grip around a coupling element 6 on the adapter 2 or an attachment and catch the attachment in a catch position in the event of an unintentional movement of the locking elements 12 into a release position by engagement of the coupling element 6 with the catch hooks 17. The pivoting arrangement allows the catch hooks 17 to move between a folded-down change- and catch position shown in FIG. 3, which allows the change operation, and a folded-up safety position shown in FIG. 4, which encloses the receptacle 8. In the raised safety position shown in FIG. 4, the two receptacles 8 are completely closed by the catch hooks 17.

As can be seen in particular from FIG. 2, the carrier 7 contains two connecting bars 19 which project rearward and are spaced apart from one another and to which the two catch hooks 17 are hinged so as to be pivotable about a transverse axis 18 in each case. The connecting bars 19 arranged on the carrier 7 below the receptacles 9 and projecting rearwardly each contain a central slot 20 in which a catch hook 17 is pivotably arranged in each case.

Figure 3:
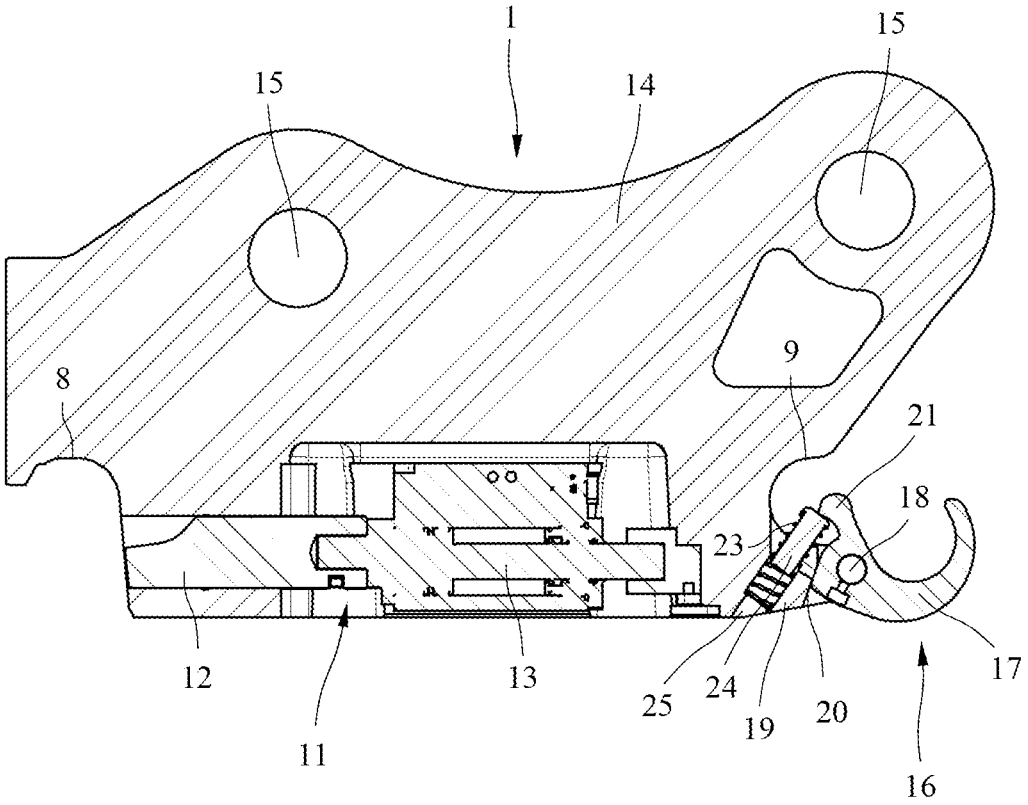
FIG. 3 a sectional view of the quick coupler of FIG. 2 with the catch device in an open change position.
Figure 4:
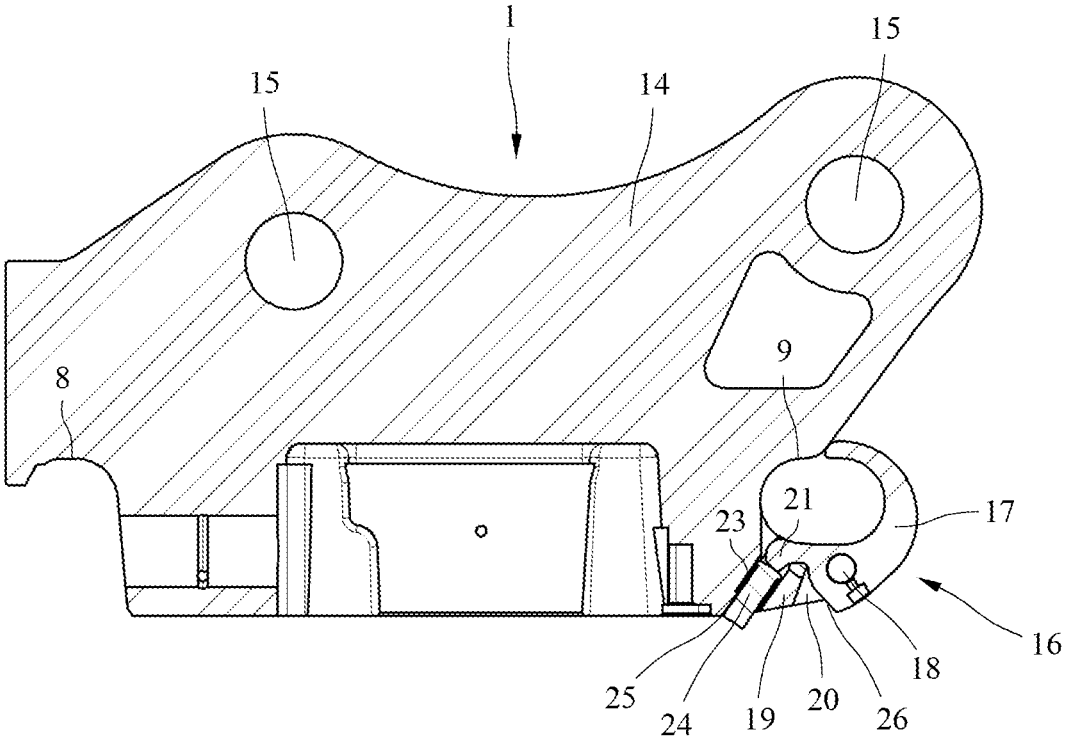
FIG. 4 a sectional view of the quick coupler of FIG. 2 with the catch device in a closed catch position.

In FIGS. 3 and 4, it can be seen particularly well that a control element 21 designed for actuation by the coupling element 6 is further provided on the catch hook 17. The control element 21, which is designed as a nose-shaped driver, is designed in such a way that, in the folded-down position of the catch hook 17, it projects inwards relative to the inner contour of the receptacle 8 and, in the folded-up safety position of the catch hook 17, it engages in a groove-shaped recess 22 on the receptacle 9, shown in FIG. 2, with the inner contour thereof terminating. The control element 21 allows the catch hook 17 to be moved by the coupling element 6 from the folded-down change- and catch position shown in FIG. 3 to the folded-up safety position shown in FIG. 4 when the coupling element 6 engages the receptacle 9. The control element 21 also ensures that the catch hook 17 can only be moved into the change- and catch position enabling a change operation when the coupling element 6 is correctly positioned in the catch hook 17. The two catch hooks 17 are also pushed into the folded-down change- and catch position by a reset device.

In the embodiment shown, the reset device is designed as a spring assembly. It has a bolt-shaped pressure element 24 associated with each catch hook 17 and pretensioned by a pressure spring 23, by means of which the catch hook 17 is pushed into its folded-down change- and catch position. The bolt-shaped pressure element 24 is arranged in a corresponding inclined bore 25 in the carrier 7 and presses with its upper end against the underside of the nose-shaped control element 21. However, the reset device can also be designed differently.

The catch hooks 17 are designed in such a way that they enclose the coupling element 6 in a semicircular manner at approximately 180°. This makes it possible to achieve particularly secure holding in any position of the quick coupler 1. In the folded-up safety position of the catch hook 17, the receptacle 9 is completely enclosed to the rear by the catch hook 17. In this folded-up safety position, the catch hook 17 also does not protrude particularly far from the carrier 7, resulting in a compact design and considerably reducing the risk of possible collisions with an attachment. Even if the coupling element 6 disengages from the receptacle 9 and is caught by the catch hook 17, the shape of the catch hook 17 ensures a secure holding.

As shown in FIG. 1, the catch hook 17 has an abutment surface 26 on its underside for contact with a front contact surface 27 of the carrier 7 below the receptacle 9. In its downwardly pivoted unfolded position, the catch hook 17 rests with its abutment surface 26 against the contact surface 27 of the carrier 7, so that the catch hook 17 is held in this lower change- and catch position. In its upwardly raised safety position, the catch hook 17 rests with an upper contact surface 28 against a corresponding counter surface 29 of the carrier 7.

The catch device 16 described above represents an additional safety device by means of which an attachment can be safely caught and held even if the locking device is unintentionally released. The catch device 16 is independent of the locking device 11 and is not coupled to it.

LIST OF REFERENCE SIGNS

1 Quick coupler
2 Adapter
3 Base plate
4 Side plate
5 First coupling element
6 Second coupling element
7 Carrier
8 First receptacle
9 Second receptacle
10 Contact surface
11 Locking device
12 Locking element
13 Cylinder
14 Side part
15 Opening
16 Catch device
17 Catch hook
18 Transverse axis
19 Connecting bar
20 Slot
21 Control element
22 Recess
23 Pressure spring
24 Pressure element
24 Control element
25 Bore
26 Abutment surface
27 Contact surface
28 Upper contact surface
29 Counter surface

The invention claimed is:

1. A quick coupler for changing attachments on a construction machine, the quick coupler comprising:

a carrier, first receptacles arranged on one side of the carrier for a first coupling element, second receptacles arranged on the other side of the carrier for a second coupling element, a locking device associated with the first receptacles and movable between a release position and a locking position, and a catch device arranged on the carrier and having at least one catch hook pivotably arranged on the carrier for catching the attachment, wherein a control element is arranged on the catch hook for pivoting the catch hook independently of the locking device between a folded-down change and catch position and a folded-up safety position, wherein the catch hook is pushed into the folded-down change and catch position by a reset device, wherein the reset device comprises a bolt-shaped pressure element associated with the at least one catch hook and biased by a pressure spring, and wherein the bolt-shaped pressure element is arranged in a bore of the carrier and pushes with an upper end against an underside of the control element on the at least one catch hook.

2. The quick coupler according to claim 1, wherein the control element is designed as a nose-shaped driver projecting from the at least one catch hook and arranged in a region of the second receptacles.

3. The quick coupler according to claim 1, wherein the at least one catch hook comprises two catch hooks arranged at a distance from one another on the carrier.

4. The quick coupler according to claim 3, wherein the catch hooks are arranged on the second receptacles of the carrier.

5. The quick coupler according to claim 3, wherein the catch hooks are pivotably arranged about transverse axes in central slots of two connecting bars projecting rearwardly from the carrier.

6. The quick coupler according to claim 3, wherein groove-shaped recesses are provided on the second receptacles for receiving the control element in the folded-up safety position of the catch hooks.

7. The quick coupler according to claim 1, wherein the at least one catch hook is designed in such a way that the at least one catch hook encloses the second coupling element in a semicircular manner.

8. The quick coupler according to claim 1, wherein the at least one catch hook has on an underside an abutment surface for contact with a contact surface of the carrier.

9. A quick coupler arrangement comprising the quick coupler according to claim 1 and an adapter that is coupleable to the quick coupler.

* * * * *